US005376787A

United States Patent [19]

Smith

[11] Patent Number: 5,376,787

[45] Date of Patent: Dec. 27, 1994

[54] MASS SPECTROMETER WITH ADJUSTABLE APERTURE MECHANISM

[75] Inventor: Peter L. Smith, Cambridge, England

[73] Assignee: Fisons plc, Ipswich, England

[21] Appl. No.: 119,985

[22] Filed: Sep. 10, 1993

[30] Foreign Application Priority Data

Sep. 11, 1992 [GB] United Kingdom ..... 9219239

[51] Int. Cl.[5] ..... H01J 49/02

[52] U.S. Cl. ..... 250/281; 250/298; 250/296; 250/283

[58] Field of Search ..... 250/299, 298, 296, 283, 250/281

[56] References Cited

U.S. PATENT DOCUMENTS

| | | | |
|---|---|---|---|
| 2,852,684 | 9/1958 | Payne, Jr. | 250/41.9 |
| 3,228,291 | 1/1966 | Miller | 250/281 |
| 3,433,945 | 3/1969 | Erickson et al. | 250/41.9 |
| 3,522,428 | 8/1970 | Powers | 250/41.9 |
| 3,546,450 | 12/1970 | Burns | 250/281 |
| 3,655,963 | 4/1972 | Brunnee et al. | 250/41.9 D |
| 4,524,275 | 6/1985 | Cottrell | 250/298 |
| 4,595,831 | 6/1986 | Hetherington, Jr. | 250/281 |

FOREIGN PATENT DOCUMENTS

| | | | |
|---|---|---|---|
| 60-180054 | 9/1985 | Japan | 250/281 |
| 2146790 | 4/1985 | United Kingdom . | |

*Primary Examiner*—Jack I. Berman

*Attorney, Agent, or Firm*—Chilton, Alix & Van Kirk

[57] ABSTRACT

In a mass spectrometer, an aperture defining a beam path to a particle detector (4) is defined by a fixed aperture (5) and a cover (6) mounted on respective carriage assemblies (50,49) running along a beam 46. When a shaft (36) drives carriage (50), a rod (22) on carriage (49) is engaged by an end of a slot (21) of carriage (50), so that both carriages can be moved to a desired aperture location. After reaching this position, carriage (50) may be moved in the opposite direction, within a range defined by the length of the slot (22), without causing movement of carriage (49), to vary the amount by which member (6) covers member (5) and to thereby define a desired aperture width. A plurality of carriages can be coupled to one another in this manner to form a chain of apertures whose positions and widths may be varied independently using a single drive shaft (36). The fixed aperture (5) and cover (6) may be replaced by a pair of opposed aperture-edge defining members in the same plane.

20 Claims, 7 Drawing Sheets

MASS SPECTROMETER WITH ADJUSTABLE APERTURE MECHANISM

FIELD OF THE INVENTION

The invention relates to mass spectrometers. It is particularly, although not exclusively, useful in multiple-collector mass spectrometers such as magnetic sector mass spectrometers for measuring isotopic ratios. Such mass spectrometers typically have multiple collectors for detecting different isotopes simultaneously.

BACKGROUND OF THE INVENTION

Multiple collector mass spectrometers are known with which it is possible to measure the isotopic ratios of different elements. In these devices, the relative positions of the various collectors are usually made adjustable because the spacing between the ion beams of different mass-to-charge ratios at the collectors is dependent on the actual value of the mass-to-charge ratios as well as the difference between them. Also, due to aberrations, the theoretically predicted positions of the beams may not be borne out in practice and adjustments in the collector positions may have to be made.

A device which permits the adjustment of collector spacings is shown in U.S. Pat. No. 4,524,275 "Multiple Collector Mass Spectrometers" by J. S. Cottrell et al. This shows a fixed central aperture with a plurality of movable apertures either side. Another device with movable collectors is shown in U.S. Pat. No. 3,522,428 "Mass Spectrometer having a Plurality of Relatively Movable Collectors" by P. Powers. This device employs a number of positionable collectors sliding on a track.

Another method of varying collector aperture spacing is shown in U.S. Pat. No. 4,595,831 "Multiple Mass Range Triple Collector Spectrometer" by E. A. Hetherington Jr. In this device the collector apertures are on a rotating plate behind which are positioned Faraday cup detectors. The plate has a plurality of aperture clusters at various positions and it can be rotated so that different aperture clusters are presented to the beam. One major disadvantage of this design is that it is only possible to select between a fixed number of aperture spacings, and these cannot easily be altered.

In addition to variable aperture spacing, it is also desirable to have variable aperture size in order to be able to optimise the spectrometer resolution over the range of the different elements to be studied.

In single slit mass spectrometers, many different techniques are known for varying aperture size, see for example GB2146790 "Device for adjusting slit widths in spectrometers", assigned to Finnigan Mat GmbH. In this apparatus the slit jaws are adjusted by a piezoelectric element. A single adjustable slit is also shown in U.S. Pat. No. 3,655,963 "Device for controlling the slit width of adjustable slit electrodes in mass spectrometers" by Brunnee et al. In this device, the slit width is adjusted by means of a heated wire, the length of which varies with temperature.

These known systems have disadvantages—the piezoelectric adjustment mechanism is expensive, and the heated wire mechanism can be unreliable. Also, the use of a mechanical aperture size adjustment technique in combination with adjustable aperture positioning would involve a great increase in complexity and expense, as a separate mechanical linkage passing through the wall of the vacuum housing has to be provided for separately adjusting both the size and position of each aperture. At the high vacuum necessary for the proper operation of isotope-ratio mass spectrometers, this involves much complex and expensive engineering.

OBJECTS OF THE INVENTION

An object of the present invention is therefore to provide an improved mass spectrometer having a charged-particle source, a mass analyzer for dispersing the charged particle beam according to the mass-to-charge ratio of the charged particles and a charged-particle detecting portion, said spectrometer having at least one aperture adjustable both in its position and its size by a single control mechanism.

Another object of the invention is to provide a multi-collector mass spectrometer having a charged-particle source, a mass analyzer for dispersing the charged particle beam and charged-particle detecting means having a plurality of collector apertures, each aperture being adjustable along the focal plane of the spectrometer both in position and size by a single control mechanism.

Another object of the invention is to provide an improved multi-collector assembly suitable for use in such a mass spectrometer.

SUMMARY OF THE INVENTION

In accordance with the above-mentioned objects, the invention provides a mass spectrometer having a vacuum housing containing a charged-particle source, typically an ion source, for producing a charged-particle beam, typically an ion beam, a mass analyzer for dispersing the charged-particle beam, and a charged-particle detector, said mass spectrometer having at least one charged particle beam-defining aperture, the or each aperture being defined by first and second aperture-defining members forming first and second lateral extremities of the aperture respectively, said first and second aperture-defining members being relatively laterally movable to increase or decrease the width of aperture presented to the beam, vacuum sealed driving means mounted on said vacuum housing for transmitting motion to one of said first and second aperture-defining members to adjust the position of said member across the path of the beam, and coupling means for connecting the driven one of said first and second aperture-defining members to the non-driven one, said coupling means defining a range of relative movement of said members within which the motion of said driven member is not transmitted to said non-driven member, and being effective to move said non-driven member together with said driven member when the motion of said driven member exceeds said range.

Viewed from another aspect the invention provides a multi-collector mass spectrometer having a vacuum housing containing a charged-particle source, typically an ion source, for producing a charged-particle beam, typically an ion beam, a mass analyzer for dispersing the charged-particle beam to form a dispersed beam, and a plurality of charged-particle detectors, each detector having associated with it a charged-particle beam-defining aperture, each aperture being defined by first and second aperture-defining members forming first and second lateral extremities of the aperture respectively, said first and second aperture-defining members being relatively laterally movable to increase or decrease the width of aperture presented to the beam, vacuum sealed driving means mounted on said vacuum housing for transmitting motion to one of said first and second aperture-defining members to adjust the position of said member across the path of the beam, and coupling means for connecting the driven one of said first and second aperture-defining members to the non-driven one, said coupling means defining a range of relative movement of said members within which the motion of said driven member is not transmitted to said non-driven member, and being effective to move said non-driven member together with said driven member when the motion of said driven member exceeds said range.

In one embodiment, separate driving means may be provided for each beam-defining aperture, each said driving means being connected to one of said first aperture-defining member and said second aperture-defining member, said first and second aperture-defining members being connected together by a coupling means as described above, whereby both the width and the position of each beam-defining aperture are adjustable by its associated driving means.

In another embodiment, one driving means is provided for a plurality of adjacent beam-defining apertures, each beam-defining aperture consisting of a first aperture-defining member and a second aperture-defining member, each aperture-defining member being connected to each adjacent aperture-defining member by a coupling means as described above so that each pair of adjacent first and second aperture-defining members defines an aperture, each aperture being coupled by a said coupling member to each adjacent aperture to form a chain of apertures, said driving means being connected to the aperture-defining member at one extremity of the chain, whereby the width and position of all the apertures in the chain are adjustable by the operation of said driving means.

Viewed from another aspect the invention provides an assembly for use in a mass spectrometer, preferably a multi-collector assembly comprising a plurality of charged-particle detectors and a plurality of apertures for defining beam paths into said detectors, each aperture being defined by first and second aperture-defining members forming first and second lateral extremities of the aperture respectively, said first and second aperture-defining members being relatively laterally movable to increase or decrease the width of aperture presented to the beam, driving means for transmitting motion to one of said first and second aperture-defining members to adjust the position of said member across the path of the beam, and coupling means for connecting the driven one of said first and second aperture-defining members to the non-driven one, said coupling means defining a range of relative movement of said members within which the motion of said driven member is not transmitted to said non-driven member, and being effective to move said non-driven member together with said driven member when the motion of said driven member exceeds said range.

Preferably, each of said first and second aperture-defining members is mounted on a separate carriage to form a first aperture-defining member carriage assembly and a second aperture-defining member carriage assembly, only one said carriage assembly being directly driven, and the carriage assemblies being connected by said coupling means. Said coupling means may conveniently comprise, attached to one of the carriage assemblies, a protruding member constrained to move within a recessed portion carried by the other said carriage assembly, the arrangement of the protruding member and the recessed member being such that when the driven carriage assembly is moved the non-driven carriage assembly remains stationary until the protruding member encounters an end of the recessed portion, after which both carriages move together until driving is stopped. The driven carriage assembly may then be moved in the opposite direction with the non-driven carriage assembly remaining stationary, and the motion in the opposite direction continued until the driven carriage assembly reaches a position relative to the non-driven carriage assembly which corresponds to the desired aperture width, at which point driving is stopped.

The protruding member may be a pin attached to one carriage assembly and the recessed portion may be a slot formed in the other carriage assembly. In this case the range of possible aperture widths is given by the slot length minus the diameter of the pin.

Alternatively, the protruding member may be a flange attached to one carriage, the said flange being constrained to move between walls attached to the other carriage. In this case the range of possible aperture widths is given by the distance between the walls minus the thickness of the flange.

Either of the first and second aperture-defining member carriage assemblies may be driven. Similarly the protruding member may be fixed to either carriage assembly, with the corresponding recess fixed to the other.

Separate charged particle detectors, for example Faraday cups, may be used, fixed to and moving with one of each said first and second aperture-defining member carriage assemblies. Alternatively a channel-plate type detector may be used, the first and second aperture-defining members moving in front of the stationary detector to define the apertures.

In one embodiment, the first and second aperture-defining members may be in the same plane, one lateral extremity of the aperture being formed by the first aperture-defining member, the opposite lateral extremity of the aperture being defined by the second aperture-defining member, the first and second aperture-defining members being relatively laterally movable so as to vary the width of the aperture.

In another embodiment the first aperture-defining member may be an apertured member having an aperture of fixed width and the second aperture-defining member may be a covering member positioned in a plane in front of or behind said apertured member, said covering member being laterally movable with respect to said apertured member to cover more or less of the aperture thus decreasing or increasing the width of aperture presented to the beam.

Certain preferred embodiments of the invention will now be described in detail by way of example only and with reference to the figures.

DETAILED DESCRIPTION OF PREFERRED EMBODIMENTS

Figure 1:
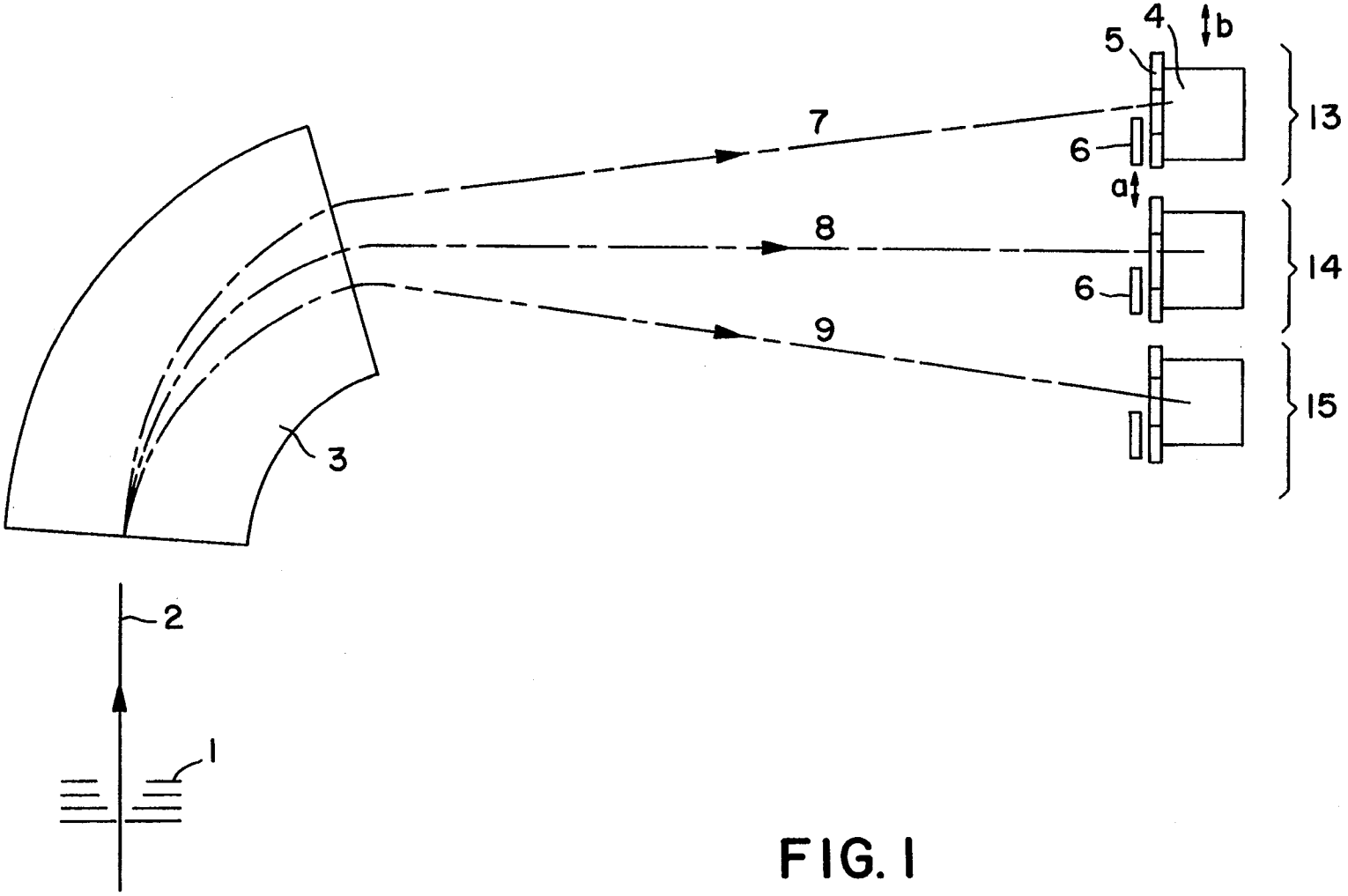
FIG. 1 is a plan view showing the ion optical arrangement of one type of single-focusing multi-collector mass spectrometer which is constructed in accordance with the present invention.

It will be appreciated that this invention is not limited to the type of mass spectrometer shown in FIG. 1, but can be applied to many types of mass spectrometers having beam-defining apertures where both position and size adjustments are required.

Referring to FIG. 1, ions are generated in the charged-particle source 1 (which may be of any suitable type) which generates a charged particle beam, typically an ion beam, and travel along trajectory 2 towards a mass analyzer 3. The ions are dispersed into beams 7, 8, 9 of different mass-to-charge ratios. Ions of the highest mass-to-charge ratio which it is desired to measure are deflected to follow trajectory 7 passing through an aperture in apertured member 5 of collector assembly 13 to enter the ion collector 4. Ions of an intermediate mass-to-charge ratio will follow trajectory 8, to enter collector assembly 14. Ions of lower mass-to-charge ratio will follow trajectory 9 to enter collector assembly 15. The collector assemblies 13, 14 and 15 are each adjustable in position along the focal plane of the mass spectrometer (see arrow b), and aperture covering members 6 are independently adjustable in position (see arrow a) to change the sizes of the apertures.

Figure 2:
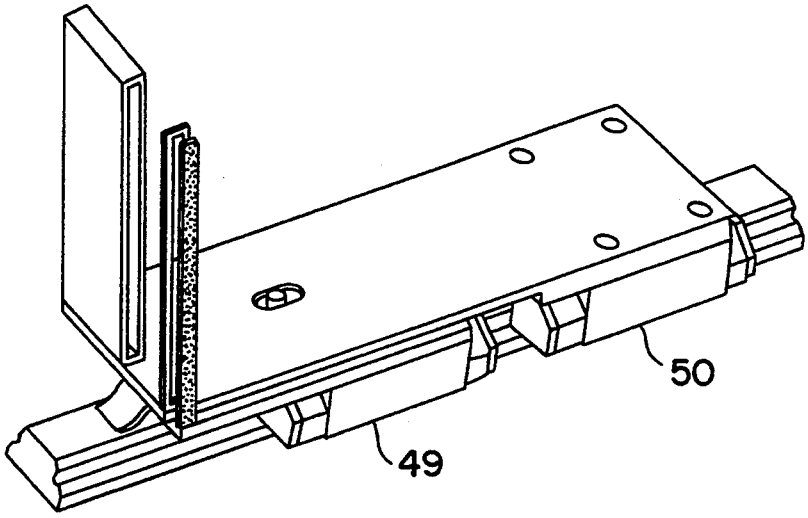
FIG. 2 shows a simplified version of a single collector assembly suitable for use in the spectrometer of FIG. 1.
Figure 3:
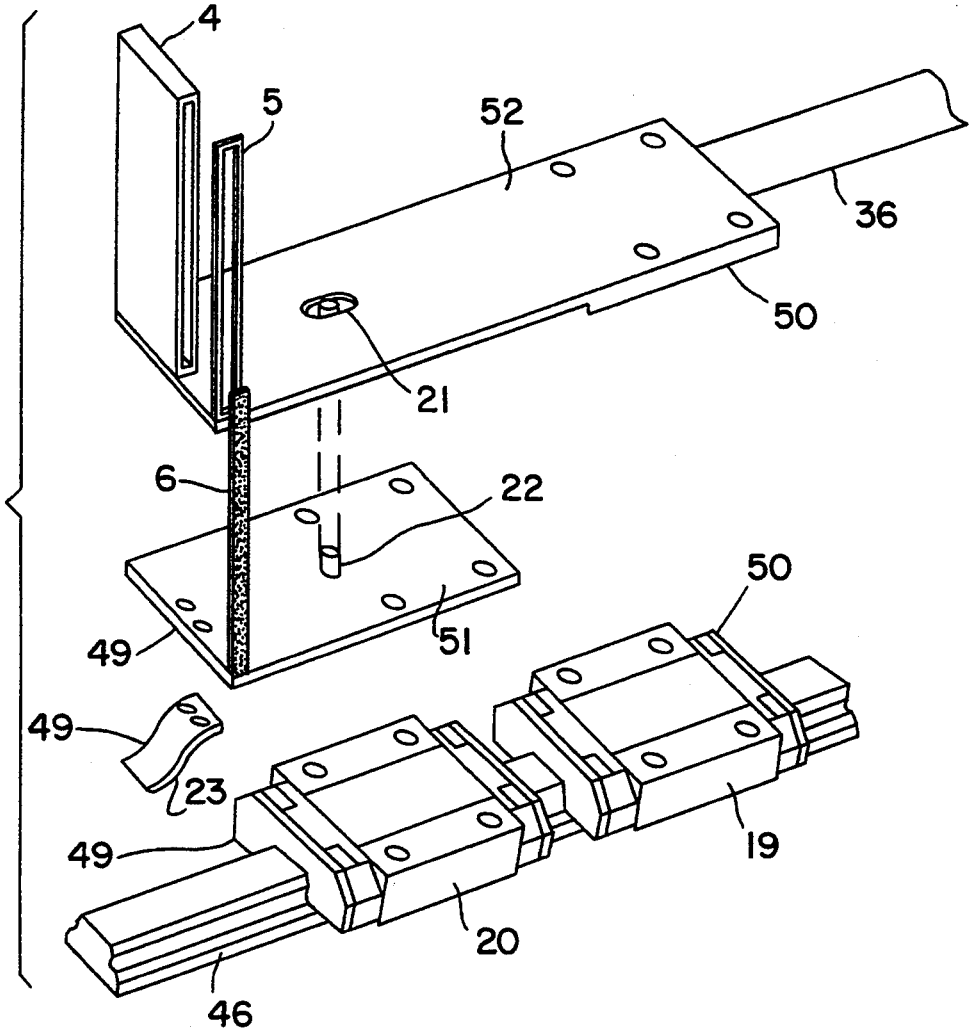
FIG. 3 is an exploded view of the collector assembly shown in FIG. 2.

A simplified version of one of the collector assemblies 13, 14, 15 is shown in FIGS. 2 and 3. It comprises a supporting cross beam 46 on which slide a collector carriage assembly 50 and an aperture cover carriage assembly 49. The collector carriage assembly 50 is reversibly driven along cross beam 46 via a drive shaft 36. The carriage assembly 50 consists of a carriage 19 on which is fixedly mounted a plate 52, carrying a collector 4 and an apertured member 5. Plate 52 also comprises a slot 21 which is adapted to receive a drive pin 22. The aperture cover carriage assembly 49 is not directly driven. It comprises a carriage 20, also sliding along beam 46, on which is mounted a plate 51. On this plate is mounted an aperture covering member 6. Aperture covering member 6 combines with apertured member 5 to define the aperture, the relative positions of members 5 and 6 defining the width of aperture presented to the beam. Also attached to plate 51 is a leaf spring 23 which damps the motion of the carriage relative to shaft 36. Pin 22 is mounted on plate 51 and engages slot 21 in plate 52. This arrangement allows the collector carriage assembly 50 to move independently of the aperture cover carriage assembly 49 within the range where the stop pin 22 is moving in the slot 21.

In order to set the position and width of the aperture, the following procedure may be followed. First, collector carriage assembly 50 is driven in the desired direction. As it moves, the leaf spring 23 overcomes the tendency of aperture cover carriage assembly 49 to move together with collector carriage assembly 50 so that the cover carriage assembly 49 remains stationary until drive pin 22 encounters the end of slot 21. Further movement of the collector carriage assembly 50 in the same direction will then cause the assemblies to move together.

The collector carriage assembly 50 is thus driven until the aperture covering member 6 reaches the desired position. The direction of movement of shaft 36 is then reversed, so that the collector carriage assembly 50 moves in the opposite direction while the aperture cover carriage assembly 49 remains stationary. This motion is continued until the desired aperture width is achieved. To adjust to a new aperture position and width the process may be repeated.

As mentioned above, either of aperture cover carriage assembly 49 or the collector carriage assembly 50 may be driven by shaft 36. Also the positions of slot 21 and drive pin 22 may be reversed.

Figure 6:
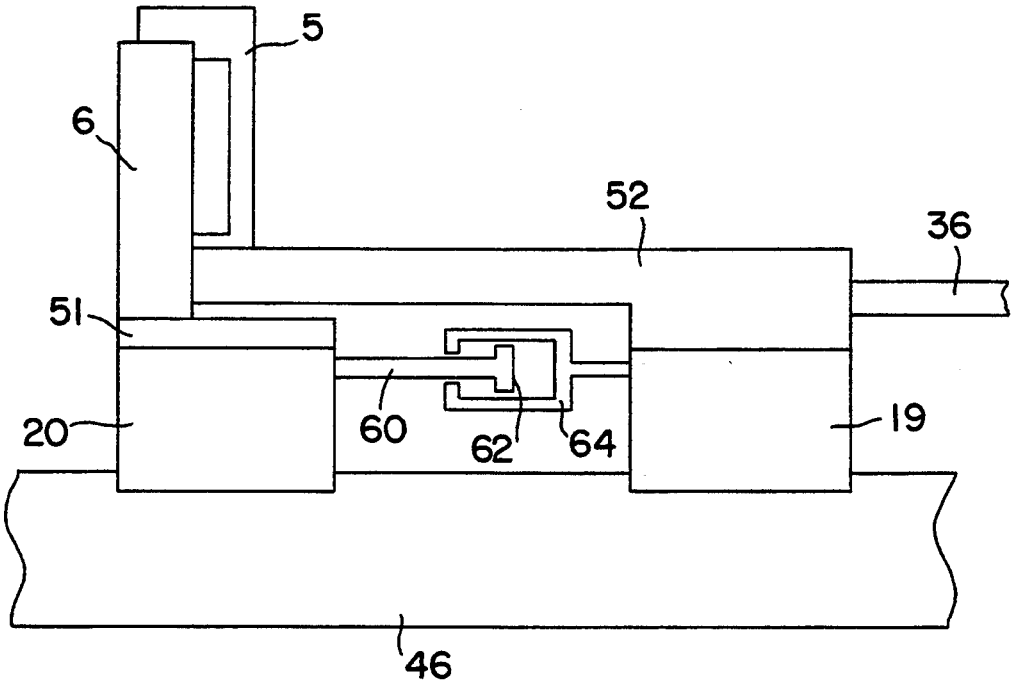
FIGS. 6 and 7 show further embodiments of coupling means suitable for use in spectrometers according to the invention.
Figure 7:
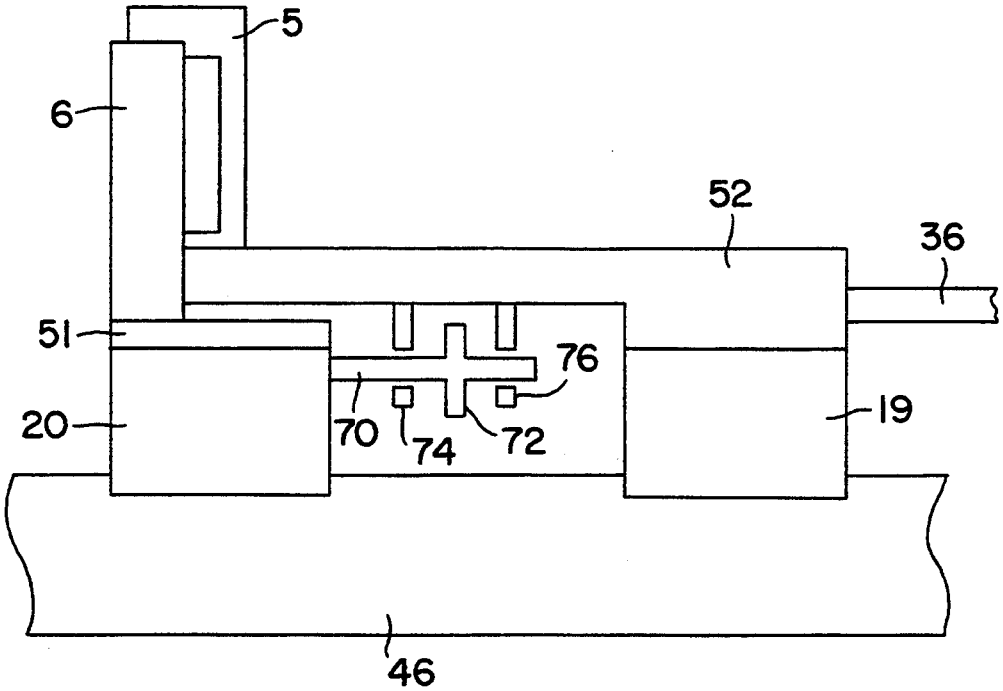

The coupling between the two carriage assemblies is not limited to a pin and slot mechanism. FIGS. 6 and 7 show two other possible coupling means. In FIG. 6, the coupling means comprises a rod 60 attached to aperture cover carriage assembly 49. The rod 60 ends in a flange 62 which is constrained to move within housing 64 attached to collector carriage assembly 50. The range of relative movement of the two carriage assemblies is defined by the distance within the housing 64 that the rod 60 can move before the flange 62 encounters an end wall. Similarly, in FIG. 7 the coupling device is a rod 70 attached to aperture cover carriage assembly 49, said rod bearing a flange 72. The rod moves within holes in plates 74 and 76 attached to collector carriage assembly 50. The range of relative movement is defined by the distance that the rod 70 can move before the flange 72 encounters either of plates 74 or 76.

Figure 4:
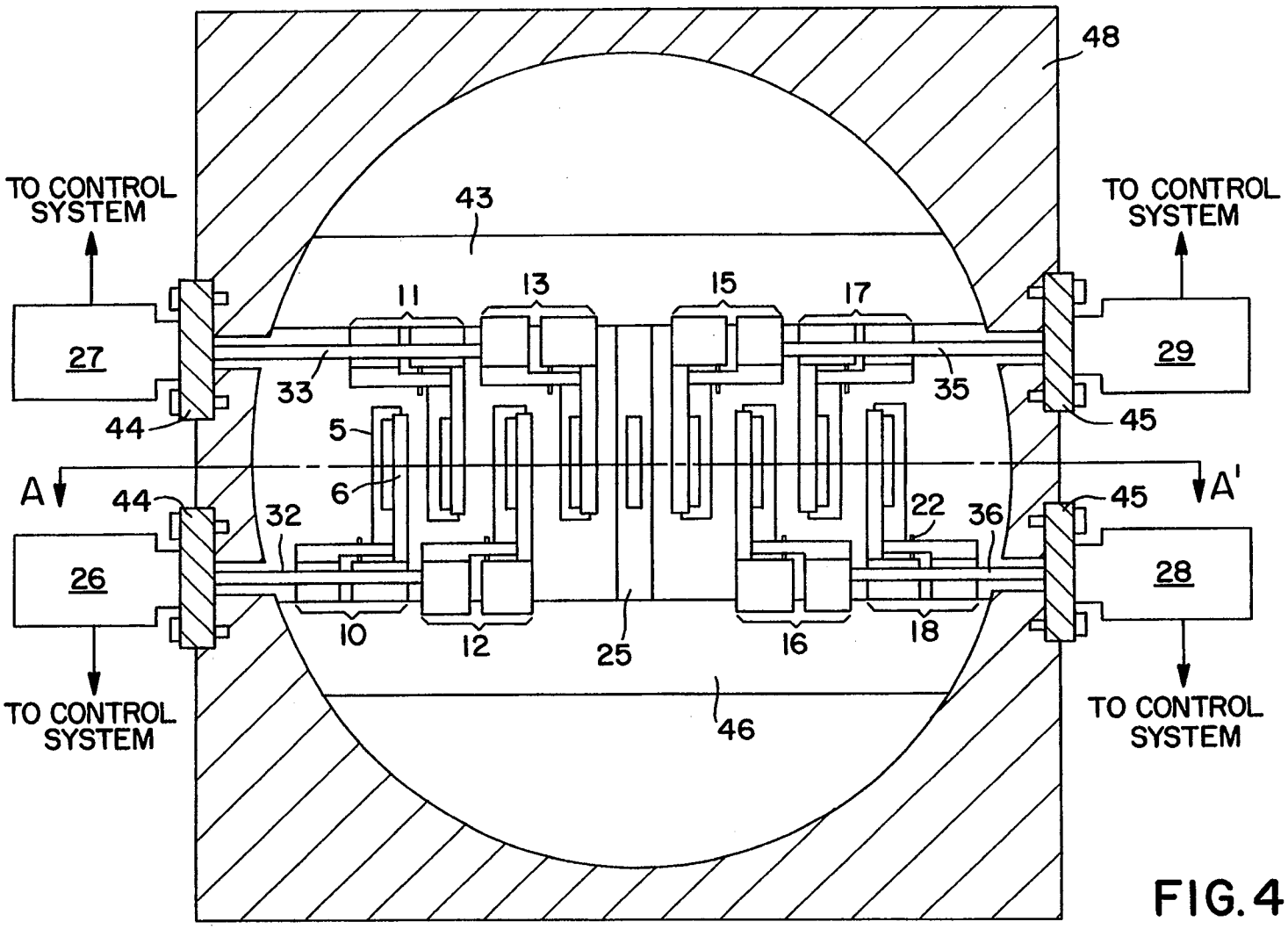
FIG. 4 is a front view of a nine-collector assembly according to the present invention.
Figure 5:
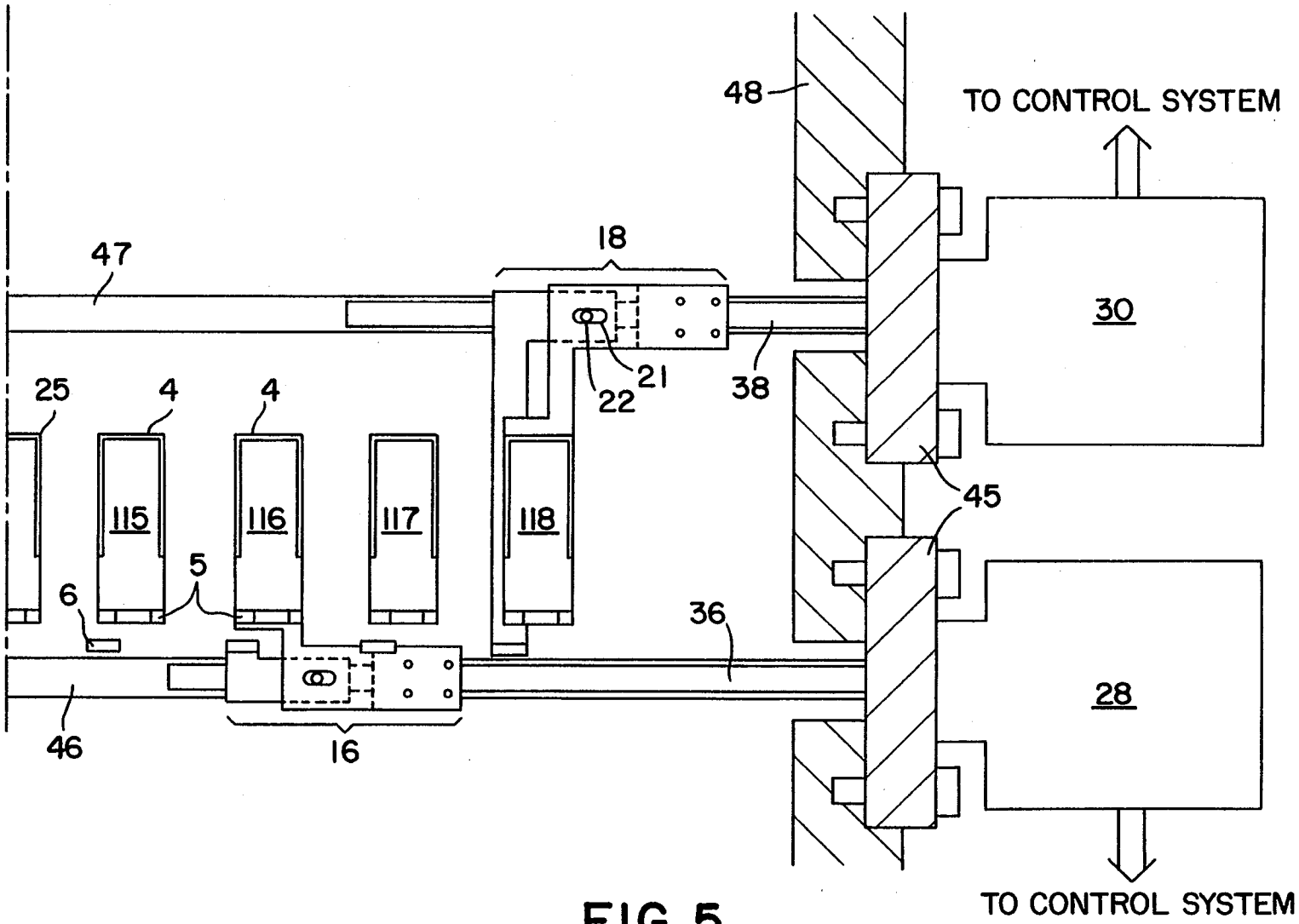
FIG. 5 is a sectional view along the line AA' in FIG. 4.

The central collector on the optical axis of the spectrometer may be fixed in position and size, as shown in FIGS. 4 and 5, or it may be adjustable in position and size by the mechanism disclosed in the invention, as shown in FIG. 1. Alternatively it may be fixed in position and have its width varied by any known means.

FIGS. 4 and 5 show a preferred embodiment of a nine-collector assembly. A vacuum housing 48 has four supporting cross beams, three of which (43, 46 and 47) are visible in the figures. The beams support a plurality of collector assemblies. The central collector 25 is fixed in position, while all the other collectors (10–13, 15–18) are adjustable in position and width as disclosed. Each adjustable collector assembly, e.g. 16, is connected via a drive shaft, e.g. 36, to a drive mechanism, e.g. 28. These are bellows driven micrometer drives which are attached to ports in the vacuum housing 48 by gold wire sealed flanges 44, 45. The drive mechanism may be controlled by a single control system e.g. a computer (not shown).

FIG. 5 is a sectional view along the plane AA' in the direction of the arrows shown on FIG. 4. Since the apparatus is symmetrical about the central axis, only one half is shown in FIG. 5. The central collector 25 is fixed as mentioned above. The four movable collectors 115–118 shown in FIG. 5 belong to collector assemblies 15, 16, 17 and 18 respectively (see FIG. 4). Collector assemblies 16 and 18 are driven along beams 46 and 47 via drive shafts 36 and 38 respectively. Assemblies 15 and 17 are suspended from the upper support beams in a similar manner. It is also possible to have all drive shafts and collector assemblies supported from below and interleaved in a similar manner.

For a 7-collector system, two of the drive systems are omitted, and blank flanges cover the ports. Similar systems involving more adjustable collector assemblies can be devised.

The carriages (19, 20) are commercially available units made of stainless steel running on recirculating ball bearings.

It is also within the scope of the invention to cascade the operation of a plurality of collector assemblies controlled by one drive. This is illustrated schematically in FIGS. 8A–8C. Multiple carriage assemblies (849, 850, 879, 880, 889 . . . ) slide on supporting beam 46 and are joined together to form a chain. Alternating carriage assemblies carry apertured members and aperture covering members (not shown in the figures).

Carriage assembly 849 is linked to carriage assembly 850 by a slot and pin mechanism 821, 822. Similar mechanisms link the other carriage assemblies. The carriage assembly which is directly driven is at the other end of the chain, not shown in the diagram.

Figure 8A:
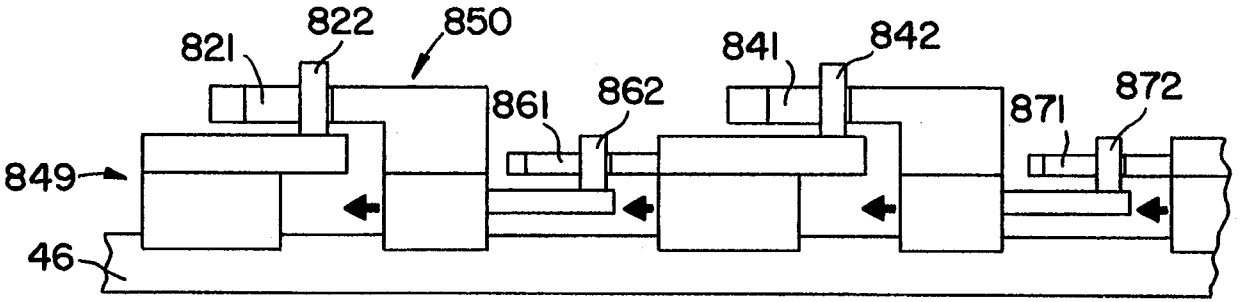
FIGS. 8*a*, 8*b* and 8*c* show an embodiment where multiple apertures are set in position and width by a single drive.
Figure 8B:
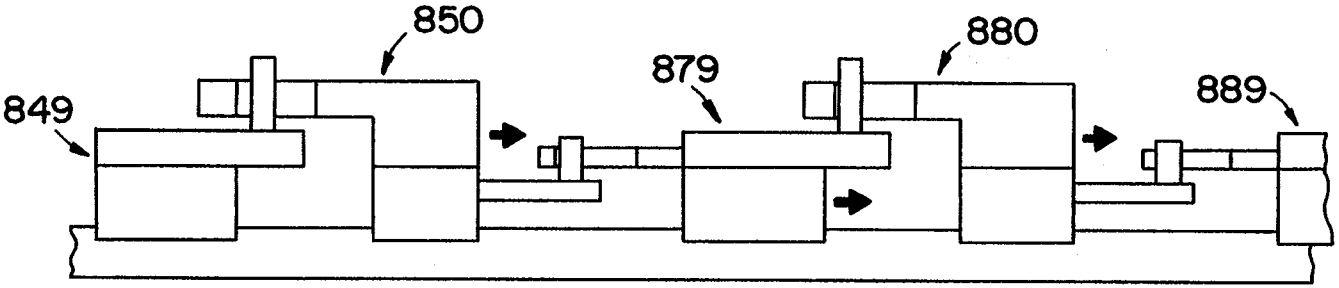
Figure 8C:
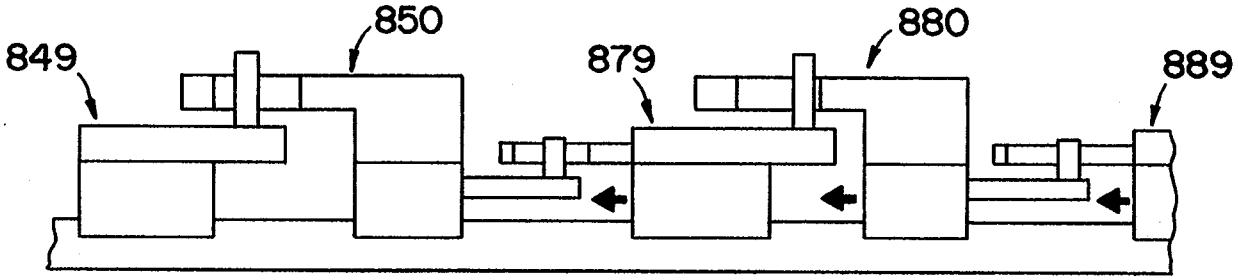

The positions of the carriages are adjusted as follows:

Firstly, as shown in FIG. 8A, the driven carriage assembly (not shown) is driven in the desired direction—leftwards in the figure—until all pins (872, 842, 862, 822) are engaged by the rightmost wall of all slots (871, 841, 861, 821) moving all the carriage assemblies (849, 850, 879, 880, 889) leftwards as shown by the arrows until carriage 849 reaches the desired position. Then the movement of the driven carriage is reversed (see FIG. 8B) until all pins (872, 842, 862) except pin 822 are engaged by the leftmost wall of the slots, moving all carriages except carriage 849 rightwards.

When carriage 850 has reached the desired position with respect to carriage 849, the drive is again reversed (see FIG. 8C) to position carriage 879 with respect to carriage 850. This backwards-and-forwards motion is repeated down the chain until the relative positions of all carriages, (and hence the positions and widths of all apertures) have been set.

Figure 9:
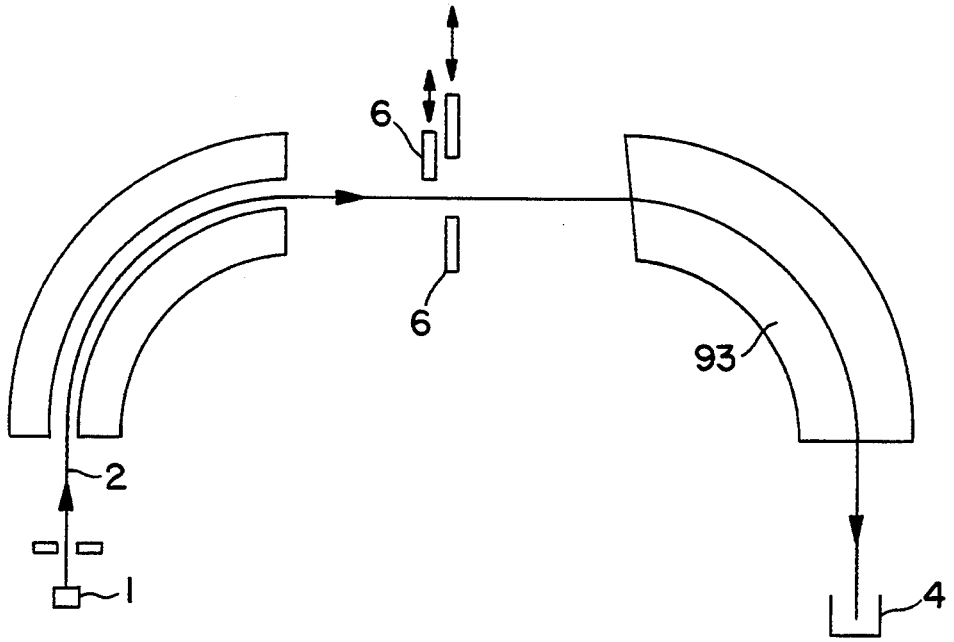
FIG. 9 is a schematic diagram of an embodiment of the present invention used in a double-focusing mass spectrometer.

FIG. 9 shows another embodiment of the present invention. In FIG. 9, the adjustable width slit (5, 6) is shown as the intermediate slit located between the electrostatic sector 92 and the magnetic sector 93 of a double-focusing mass spectrometer. In such a mass spectrometer it is useful to provide an adjustable width slit to allow enhanced transmission at less than the maximum possible resolution, and an adjustably positioned slit is useful for compensating mechanical imperfections as well as techniques such as Ion-Kinetic Energy Spectrometry.

Figure 10:
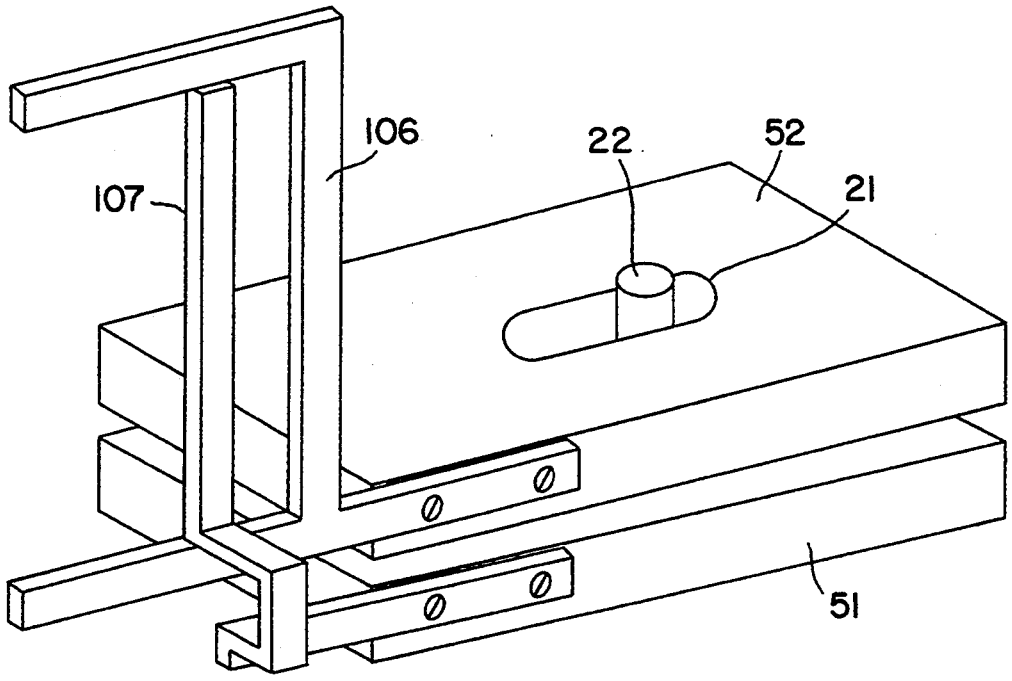
FIG. 10 shows a further embodiment of an adjustable aperture.

FIG. 10 shows an alternative construction of the aperture mechanism where the aperture is defined by two aperture defining members 106, 107 which are in the same plane. This construction may be preferable at high resolutions.

I claim:

1. A mass spectrometer having a vacuum housing containing:

a) a source for producing a charged-particle beam;

b) a mass analyzer for dispersing said beam;

c) at least one charged-particle detector; and d) at least one means for defining a beam aperture, said means comprising first and second aperture-defining members;

wherein said first and second aperture-defining members are relatively movable to increase or decrease a width of said aperture presented to said beam; and wherein said vacuum housing has vacuum sealed driving means mounted thereon which transmits motion to one of said first and second aperture-defining members to adjust the position of said one (driven) member across the path of said beam, said driven aperture-defining member being connected to the other (non-driven) member by coupling means, said coupling means defining a range of relative movement of said members within which motion of said driven member is not transmitted to said non-driven member, said coupling means being effective to move said non-driven member together with said driven member when movement of said driven member exceeds said range.

2. A mass spectrometer according to claim 1, wherein said mass spectrometer comprises a plurality of said aperture-defining means, and wherein separate driving means are provided for each said aperture-defining means.

3. A mass spectrometer according to claim 1, wherein said mass spectrometer comprises a plurality of said aperture-defining means and wherein one driving means is provided for a plurality of said aperture-defining means, each of said first and second members being connected to each adjacent member by a said coupling means so that each aperture-defining means is coupled to each adjacent aperture-defining means to form said chain of aperture-defining means, said driving means being connected to an aperture-defining member at one extremity of said chain, the width and position of all the aperture-defining means in said chain being adjustable by operation of said driving means.

4. A mass spectrometer according to claim 1, wherein said first and second aperture-defining members are mounted on separate carriages to form first and second aperture-defining member carriage assemblies, with one said carriage assembly being directly driven by said driving means, and wherein said carriage assemblies are connected by said coupling means, said coupling means comprising a protruding member of one of said carriage assemblies constrained to move within a recessed portion of the other of said carriage assemblies.

5. A mass spectrometer according to claim 4, wherein said protruding member and said recessed portion are arranged such that when said driven carriage assembly is moved in one direction said non-driven carriage assembly remains stationary until said protruding member encounters an end of said recessed portion, after which both said carriage assemblies move together until driving is stopped, said protruding member and said recessed portion being further arranged such that when said driven carriage assembly is then moved in an opposite direction said non-driven carriage assembly remains stationary to enable said driven carriage assembly move to a position relative to said non-driven carriage assembly which corresponds to a desired aperture width.

6. A mass spectrometer according to claim 4, wherein said protruding member is a pin and said recessed portion is a slot.

7. A mass spectrometer according to claim 4, wherein said protruding member is a flange attached to one carriage, said flange being constrained to move between walls of a housing attached to said other carriage.

8. A mass spectrometer according to claim 4, wherein a said aperture-defining means is provided between an electrostatic sector and a magnetic sector.

9. A mass spectrometer according to claim 1, wherein said mass spectrometer comprises one or more charged-particle detectors, each detector having associated with it a said aperture-defining means with which it moves.

10. A mass spectrometer according to claim 9, wherein a said aperture-defining means is provided between an electrostatic sector and a magnetic sector.

11. A mass spectrometer according to claim 1, wherein said mass spectrometer comprises one or more stationary detectors, said first and second aperture-defining members moving in front of said stationary detector(s) to define said aperture(s).

12. A mass spectrometer according to claim 11, wherein a said aperture-defining means is provided between an electrostatic sector and a magnetic sector.

13. A mass spectrometer according to claim 1, wherein said first and second aperture-defining members are in a common plane.

14. A mass spectrometer according to claim 13, wherein a said aperture-defining means is provided between an electrostatic sector and a magnetic sector.

15. A mass spectrometer according to claim 1, wherein said first and second aperture defining members comprise a member defining an aperture of fixed width and a covering member movable to cover more or less of said fixed width aperture member.

16. A mass spectrometer according to claim 1, wherein a said aperture-defining means is provided between an electrostatic sector and a magnetic sector.

17. A mass spectrometer according to claim 1, wherein when said driven member reaches an end of said range, a portion of said driven member engages a portion of said non-driven member to transmit motion thereto.

18. A collector assembly for a mass spectrometer, comprising at least one charged-particle detector and at least one aperture-defining means for defining a beam path into said detector, wherein a width of an aperture defined by said aperture-defining means presented to a beam is defined by first and second aperture-defining members which are relatively movable to increase or decrease said width, said assembly further comprising driving means for transmitting motion to one of said first and second aperture-defining members to adjust the position of said one (driven) member across a path of said beam, said driven member being connected to the other (non-driven) member by coupling means, said coupling means defining a range of relative movement of said members within which motion of said driven member is not transmitted to said non-driven member, said coupling means further being effective to move said non-driven member together with said driven member when movement of said driven member exceeds said range.

19. An assembly according to claim 18, wherein said assembly is a multi-collector assembly comprising a plurality of said detectors and a plurality of said apertures-defining means.

20. A multi-channel mass spectrometer having a vacuum housing containing:

a) a source for producing a charged-particle beam;

b) a mass analyzer for dispersing said beam;

c) a plurality of charged-particle detectors; and d) a plurality of means for defining a beam aperture, each said beam aperture-defining means being associated with a said detector and each said means comprising first and second aperture-defining members;

wherein said first and second aperture-defining members are relatively movable to increase or decrease a width of said aperture presented to said beam; and wherein said vacuum housing has vacuum sealed driving means mounted thereon which transmits motion to one of said first and second aperture-defining members to adjust the position of said one (driven) member across the path of said beam, said driven aperture-defining member being connected to the other (non-driven) member by coupling means, said coupling means defining a range of relative movement of said members within which motion of said driven member is not transmitted to said non-driven member, said coupling means being effective to move said non-driven member together with said driven member when movement of said driven member exceeds said range.

* * * * *